US006343592B1

(12) United States Patent
Sonoda

(10) Patent No.: US 6,343,592 B1
(45) Date of Patent: Feb. 5, 2002

(54) EVAPORATED FUEL PIPING CONSTRUCTION FOR VEHICULAR ENGINES

(75) Inventor: Tohru Sonoda, Shizuoka-ken (JP)

(73) Assignee: Suzuki Motor Corporation, Hamamatsu (JP)

( * ) Notice: Subject to any disclaimer, the term of this patent is extended or adjusted under 35 U.S.C. 154(b) by 0 days.

(21) Appl. No.: 09/377,807

(22) Filed: Aug. 20, 1999

(30) Foreign Application Priority Data

Aug. 31, 1998 (JP) ..... 10-260993

(51) Int. Cl.[7] ..... F02M 33/02
(52) U.S. Cl. ..... 123/520; 123/184.21
(58) Field of Search ..... 123/184.57, 184.21, 123/519, 520, 184.42, 516, 521, 518

(56) References Cited

U.S. PATENT DOCUMENTS 4,727,955 A * 3/1988 Honda et al. ..... 180/296
5,477,819 A * 12/1995 Kopec ..... 123/184.42
5,531,207 A * 7/1996 Lin ..... 123/572
5,546,913 A 8/1996 Aoki
5,636,617 A * 6/1997 Nakatsu ..... 123/519
5,782,218 A * 7/1998 Akinori ..... 123/198 D
5,840,104 A * 11/1998 Hashimoto et al. ..... 96/135
5,996,543 A * 12/1999 Nakayama et al. .... 123/184.21
6,006,712 A * 12/1999 Suzuki ..... 123/184.57
6,026,775 A * 2/2000 Yamane ..... 123/184.53
6,098,586 A * 8/2000 Bloomer ..... 123/184.21

FOREIGN PATENT DOCUMENTS

JP 07286563 A 10/1995
JP 08061161 A 3/1996

* cited by examiner

*Primary Examiner*—Carl S. Miller
(74) *Attorney, Agent, or Firm*—Flynn, Thiel, Boutell & Tanis, P.C.

(57) ABSTRACT

An evaporated fuel piping construction is provided to shorten a piping path in an evaporated fuel piping construction for vehicular engines, ensure clearances between the piping path and other parts and make a purge pipe member small in sag. The purge pipe member is composed of non-flexible pipe members fixed to an engine accessory and flexible pipe members connected to the non-flexible pipe members.

8 Claims, 5 Drawing Sheets

EVAPORATED FUEL PIPING CONSTRUCTION FOR VEHICULAR ENGINES

FIELD OF THE INVENTION

The present invention relates to an evaporated fuel piping construction for a vehicular engine which supports a purge pipe member.

BACKGROUND OF THE INVENTION

In vehicles, evaporated fuel leaking to the atmosphere from a fuel tank or the like contains hydro carbons (HC) in large quantities, which is responsible partly for air pollution and leads to loss of fuel. There are known various techniques for prevention of air pollution and loss of fuel. As a typical one, there is an evaporated fuel control device (evaporative system) in which evaporated fuel in a fuel tank is absorbed by an absorbent material, such as activated charcoal, and is purged at the time of engine operation. Purge air including purged evaporated fuel is fed to the engine.

In a known piping construction for the evaporated fuel control device as shown in FIG. 10, a purge pipe member 106 is provided between a canister 102 and a throttle body 104, which is a part in an intake system, to conduct evaporated fuel from the canister 102 to the throttle body 104. The purge pipe member 106 is made-of a flexible hose, and is connected at its one end to a purge side union 108 of the canister 102, fixed at its middle portion to a vehicle body by a plurality of hose mounting clamps 110, and connected to a body side union 112 of the throttle body 104.

Such evaporated fuel piping constructions are disclosed in, for example, Japanese Patent Laid-Open Nos. 286563/1995 and 61161/1996. With the arrangement described in Japanese Patent Laid-Open No. 286563/1995, a metallic pipe is provided midway of a purge pipe member and is fixed to an engine side through a bracket together with parts such as a purge valve and the-like to suppress transmission of air current sound through the purge passage. With the arrangement described in Japanese Patent Laid-Open Nos. 61161/1996, a surge tank is provided on a purge pipe member between an intake manifold and a purge valve to flatten fluctuation in the amount of purge.

In conventional evaporated fuel piping constructions, a plurality of hose mounting clamps are mounted to a lengthy flexible hose as a purge pipe member and mounted to a vehicle body to then be connected to a throttle body as shown in FIG. 10, there is a disadvantage in that a piping path for the purge pipe member becomes too long to lack invariability or to control the position thereof. Thus, it becomes difficult to ensure clearances between the path and other adjacent parts, and a large sag is needed in the hose due to the hose being directed in a direction V (FIG. 10) perpendicular to a direction C of an engine crankshaft axis.

SUMMARY OF THE INVENTION

To eliminate or minimize the above described disadvantage, the invention provides an evaporated fuel piping construction for a vehicular engine, including a purge pipe member provided between a canister and an intake system to conduct evaporated fuel from the canister to the intake system. The purge pipe member comprises a non-flexible pipe member or members fixed to an engine accessory and a flexible pipe member or members connected to the non-flexible pipe member or members.

In the invention, the non-flexible pipe member or members, which constitute a part of the purge pipe member, are fixed to an engine accessory, and a flexible pipe member or members form the remaining part of the purge pipe member, so that it is possible to shorten the piping path for improvement in invariability, to provide substantially predetermined placement of the flexible pipe members relative to other elements of the engine, to ensure adequate clearances between the purge pipe members and other parts and to make the flexible pipe members of the purge pipe members small in sag or in the amount of free movement of the flexible pipe members.

DETAILED DESCRIPTION OF THE INVENTION

Embodiments of the invention will be described below with reference to the accompanying drawings.

Figure 1:
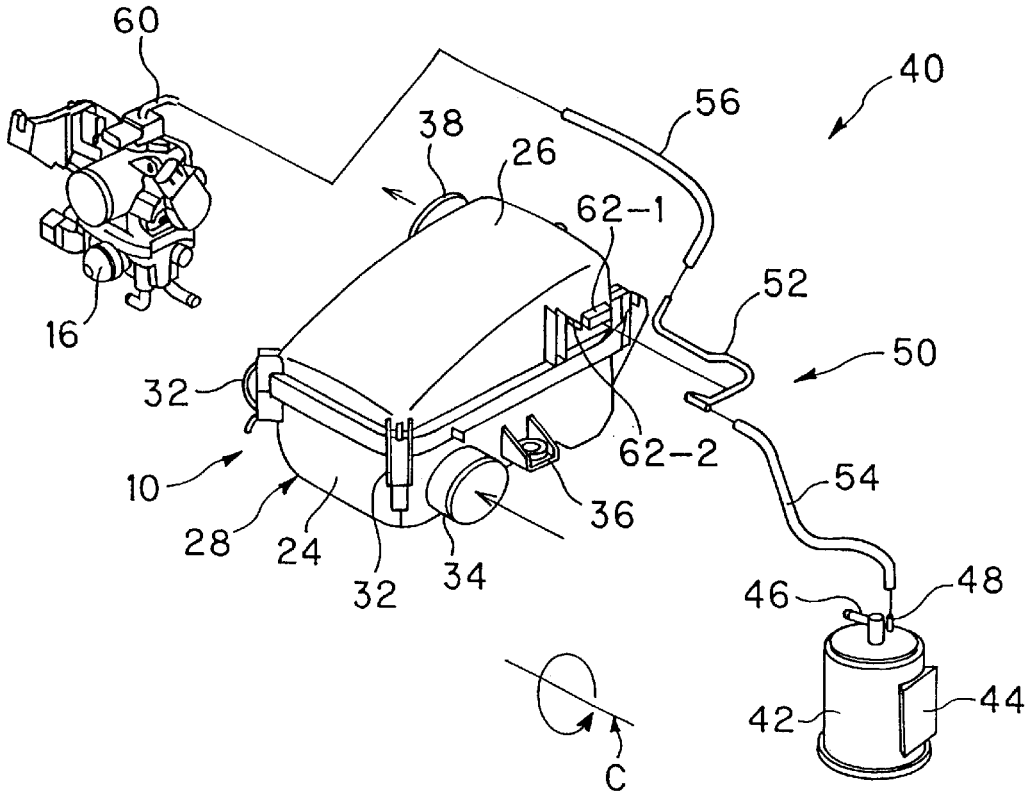
FIG. 1 is a perspective view showing an evaporated fuel piping construction.
Figure 2:
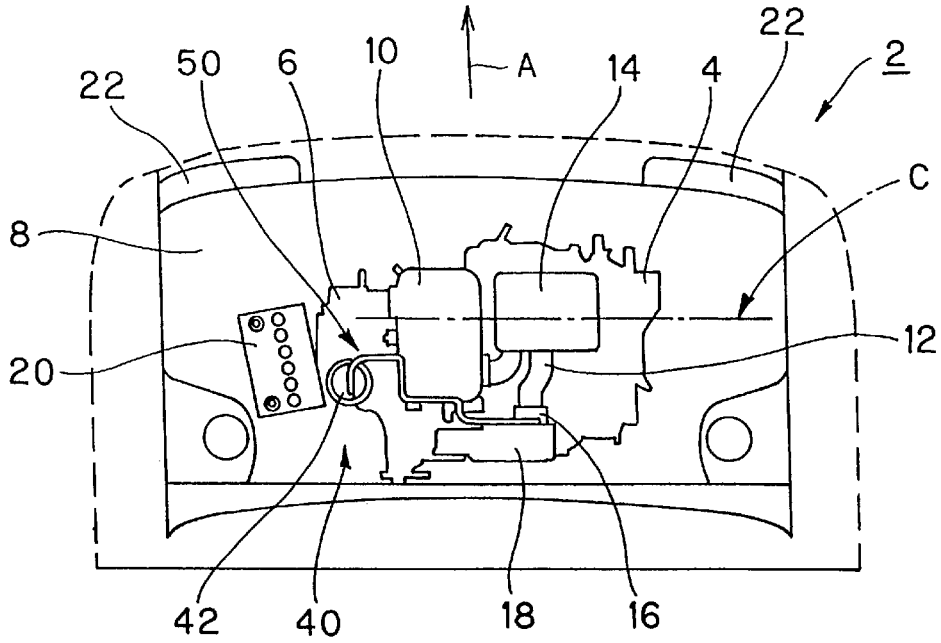
FIG. 2 is a partially plan top view showing an engine compartment of a vehicle.
Figure 3:
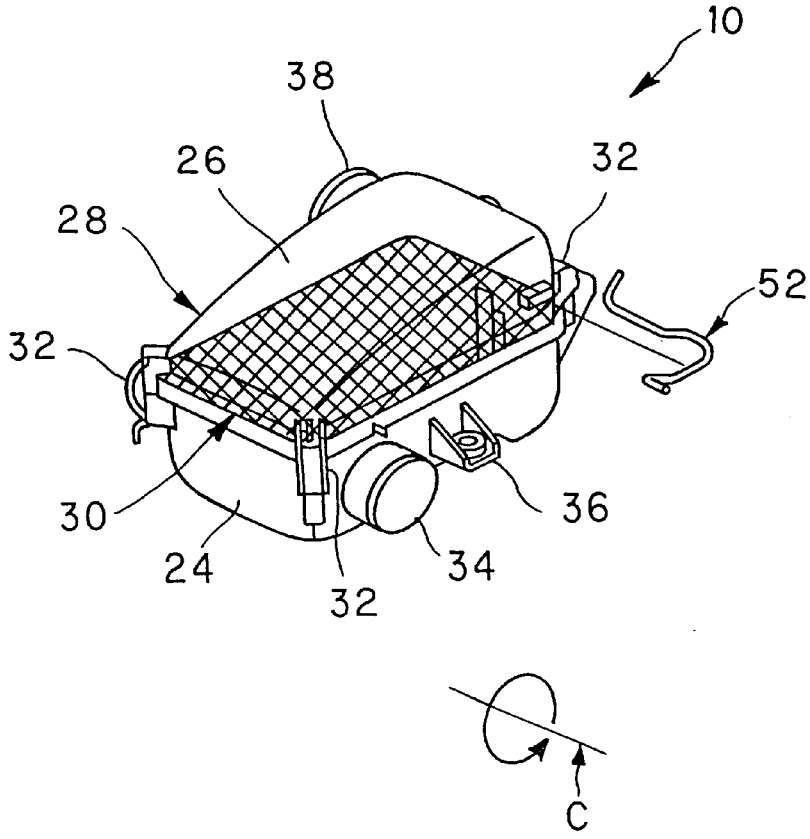
FIG. 3 is a perspective view showing an air cleaner.

FIGS. 1 to 5 show a first embodiment of the invention. In FIGS. 1 and 2, the reference numeral 2 designates a vehicle, 4 an engine, 6 a transmission, and 8 an engine room or compartment.

Arranged as engine accessories in an upper portion of the engine 4 are an air cleaner 10, a suction duct 12, a resonator 14, a throttle body 16 and a surge tank 18. Further, a body of the vehicle 2 mounts thereon a battery 20, and is provided with headlights 22. As shown in FIG. 2, arrow A represents the forward direction of travel for the vehicle 2.

The air cleaner 10 constitutes an engine accessory, and is arranged as shown in FIG. 2 to extend upwardly of the engine 4 and laterally of vehicle 2, and comprise an air cleaner casing 28 including a lower casing 24 secured to the vehicular body and an upper casing 26, and an air filter 30 provided within the lower casing 24 and the upper casing 26. The lower casing 24 and upper casing 26 are united by a casing clamp 32.

The lower casing 24 is provided with an inlet side connection pipe 34 and a mount flange 36 for mounting to the vehicular body. The upper casing 26 is provided with an outlet side connection pipe 38.

The throttle body 16 is mounted to a surge tank 18 disposed rearwardly of and rightwardly of the vehicle 2 and on the side of the engine 4 relative to the air cleaner 10.

The battery 20 constitutes an engine accessory, and is arranged leftwardly on the vehicle 2 relative to the air cleaner 10.

Mounted to the battery 20 is a canister 42 for an evaporated fuel control device 40. The canister 42 is provided with a vehicular body side mount 44 adapted to be mounted on the battery 20, an evaporative side union 46 and a purge side union 48. The evaporative side union 46 and purge side union 48 are made of a non-flexible member, for example, a metal and a synthetic resin. Connected to the evaporative side union 46 is an evaporative side pipe part (not shown).

A purge pipe member 50 is provided between the canister 42 and the throttle body 16 of an intake system. The purge pipe member 50 comprises a purge pipe 52 as a non-flexible pipe member fixed to the air cleaner 10, a canister side hose 54 as a flexible member connected to the purge pipe 52 and a body side hose 56.

Figure 4:
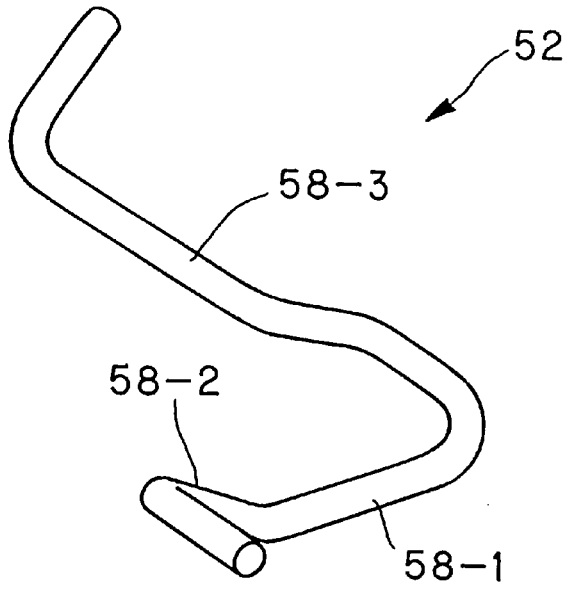
FIG. 4 is a perspective view showing a purge pipe.
Figure 5:
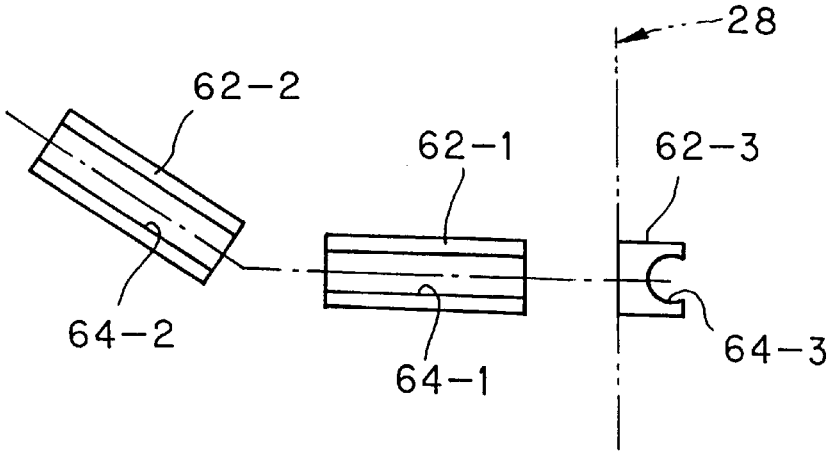
FIG. 5 is a view showing an arrangement of pipe holding portions.

The purge pipe 52 is arranged as shown in FIG. 4 along an outside configuration composed of a side surface constituting an outer surface and a rear surface of the air cleaner 10, being bent into a predetermined shape, for example, a substantially Z-shape, and comprises first to third mount portions 58-1 to 58-3.

The canister side hose 54 is connected at one end thereof to the purge side union 48 and at the other end thereof to one end of the purge pipe 52. The body side hose 56 is connected at one end thereof to the other end of the purge pipe 52 and at the other end thereof to a body side union 60 of the throttle body 16.

To fix the purge pipe 52 to the air cleaner 10, first to third pipe holding portions 62-1 to 62-3 for holding the first to third mount portions 58-1 to 58-3 are formed monolithically integrally on, for example, a side surface and a rear surface of the upper casing 26 when the upper casing 26 is molded. Formed on the first to third pipe holding portions 62-1 to 62-3 are first to third fitting grooves 64-1 to 64-3 to fit on and hold the first to third mount portions 58-1 to 58-3.

Further, the purge pipe member 50 is directed substantially toward a crank shaft axis C of the engine 4 and arranged not vertically upright but substantially horizontal.

The first embodiment will be described below.

First, to arrange the purge pipe member 50, the first to third mount portions 58-1 to 58-3 of the purge pipe 52 are beforehand fitted in and held by the first to third pipe fitting grooves 64-1 to 64-3 of the first to third pipe holding portions 62-1 to 62-3 on the upper casing 26.

Then the canister side hose 54 and the body side hose 56 are connected to both ends of the purge pipe 52. As a result, the purge pipe 52 being a non-flexible pipe member of the purge pipe member 50 is fixed to the side of the engine 2 via the air cleaner 10, so that it is possible to simultaneously ensure a dynamic clearance on the body side hose 56 so the body side hose 56 ensures a static clearance relative to respective portions of the engine 2, and to improve invariability and substantially fix the position of the body side hose 56, while the piping path is made short.

Further, since the canister side hose 54 is arranged in a direction of the crank shaft axis C and is substantially horizontal, the canister side hose 54 can be made small in play and deflection.

Also, since the purge pipe 52 is beforehand fixed to the air cleaner 10 on the side of the engine 4, the canister side hose 54 and the body side hose 56 are mounted only through insertion into the purge pipe 52 and the like to enable simple assembly.

Besides, because the purge pipe 52 is mounted to the first to third pipe holding portions 62-1 to 62-3 integrally on the upper casing 26, clamps for hose mounting, bolts and brackets for fixing, other clamps and the like are dispensed with, so that it is possible to reduce the number of parts and make construction simple and inexpensive.

Further, since the purge pipe 52 is arranged along the outside configuration of the air cleaner 10, it is possible to improve appearance and-to avoid interference of the pipe with other parts.

In describing the following embodiments, identical reference numerals designate parts which function in the same manner as in the first embodiment.

Figure 6:
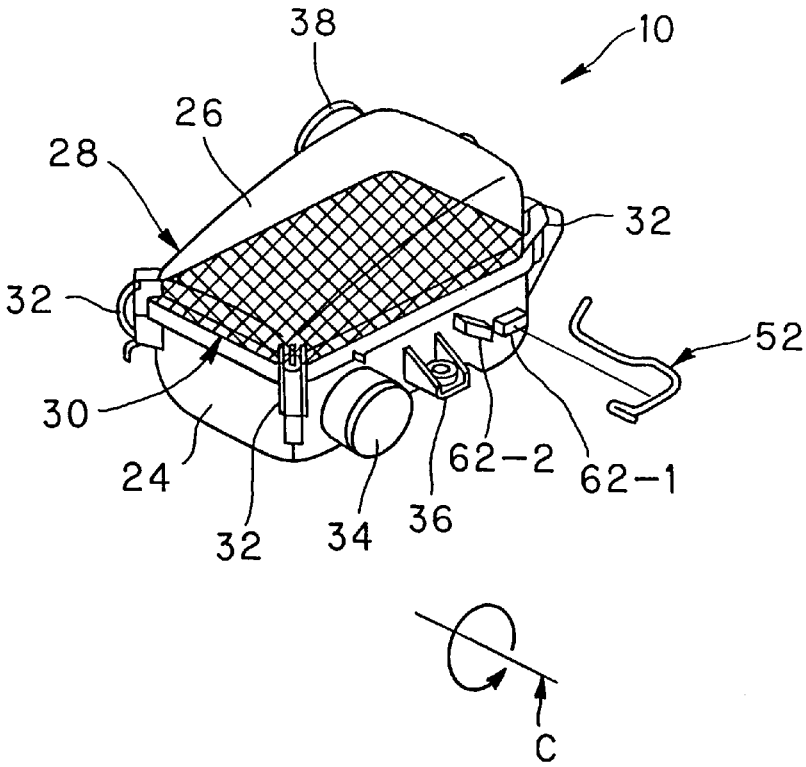
FIG. 6 is a perspective view showing an air cleaner in a second embodiment of the invention.

FIG. 6 shows a second embodiment of the invention having the following features. That is, a purge pipe 52 is mounted to pipe holding portions 62-1, 62-2 integrally formed on the lower casing 24. With the arrangement of the second embodiment, the canister side hose 54 is arranged near the crank shaft axis C, so that the canister side hose 54 becomes further small in deflection and there is no need of dismounting the purge pipe 52 and the canister side hose 54 at the time of replacement of the air filter 30, thus enabling performing the replacement work with simplicity and eliminating the need of making the canister side hose 54 longer than required.

Figure 7:
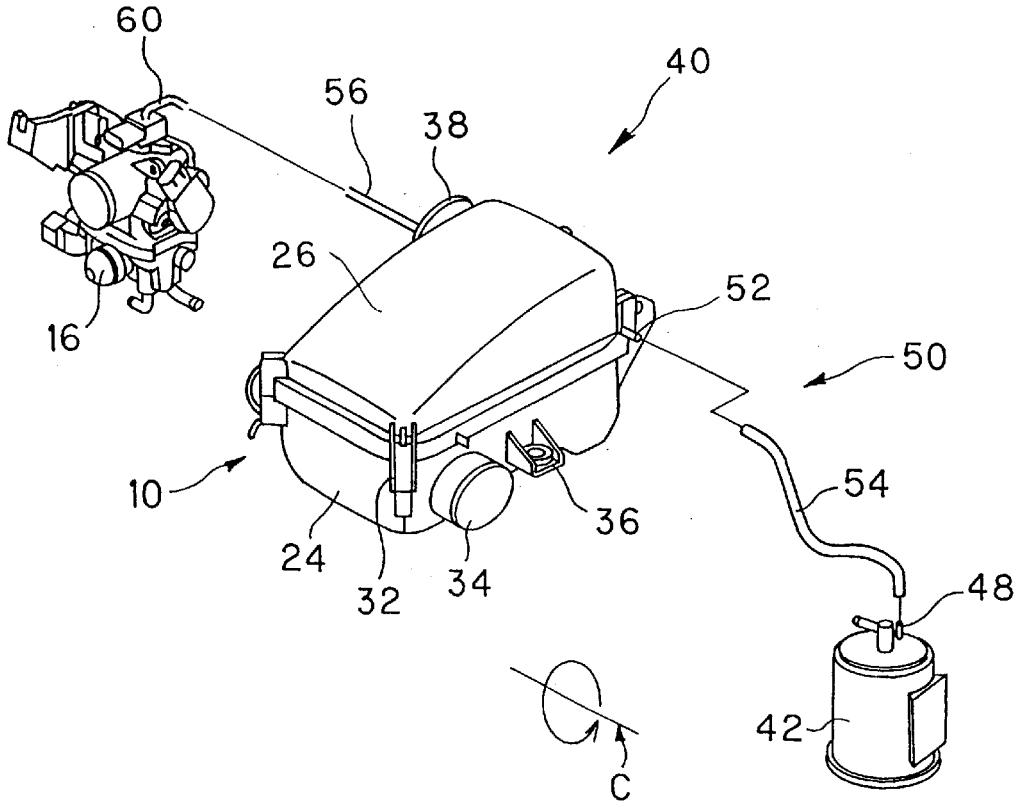
FIG. 7 is a perspective view showing an evaporated fuel piping construction in a third embodiment of the invention.
Figure 8:
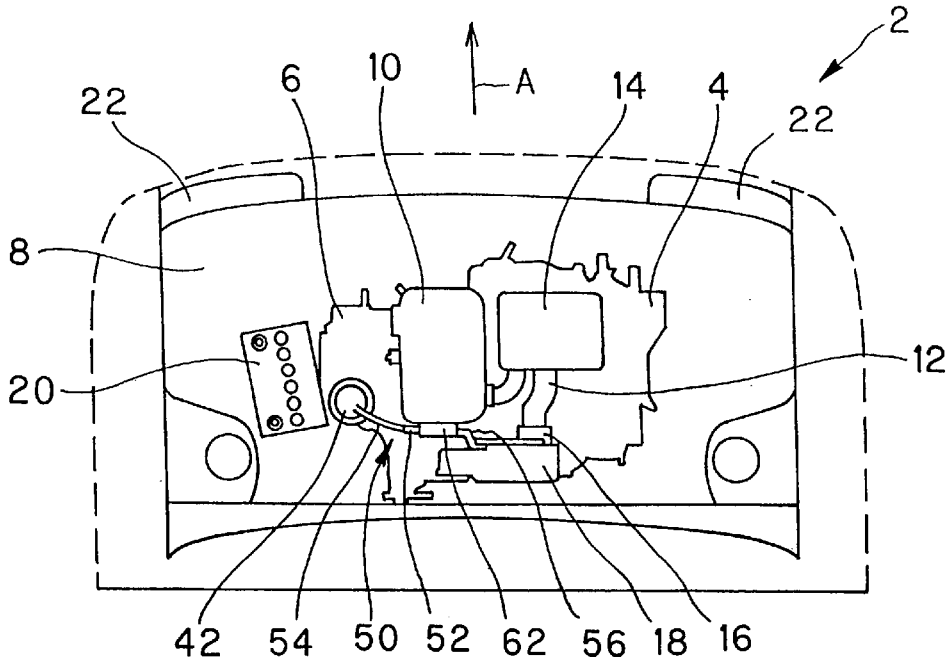
FIG. 8 is a partially plan top view showing an engine compartment of a vehicle in the third embodiment.

FIGS. 7 and 8 show a third embodiment of the invention having the following features. That is, a pipe holding portion 62 is mounted only on a rear surface on an outer surface of the lower casing 24, and a straight purge pipe 52 is mounted to the pipe holding portion 62. The purge pipe 52 is connected to a canister side hose 54 which extends straight toward the canister 42. With the arrangement of the third embodiment, it is possible to make the purge pipe 52 simple in configuration and molding, and to make the canister side hose 54 small in length and small in deflection.

Figure 9:
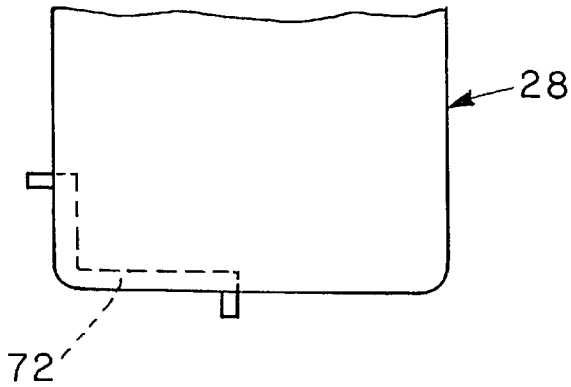
FIG. 9 is a partially plan view showing an air cleaner casing in a fourth embodiment of the invention.
Figure 10:
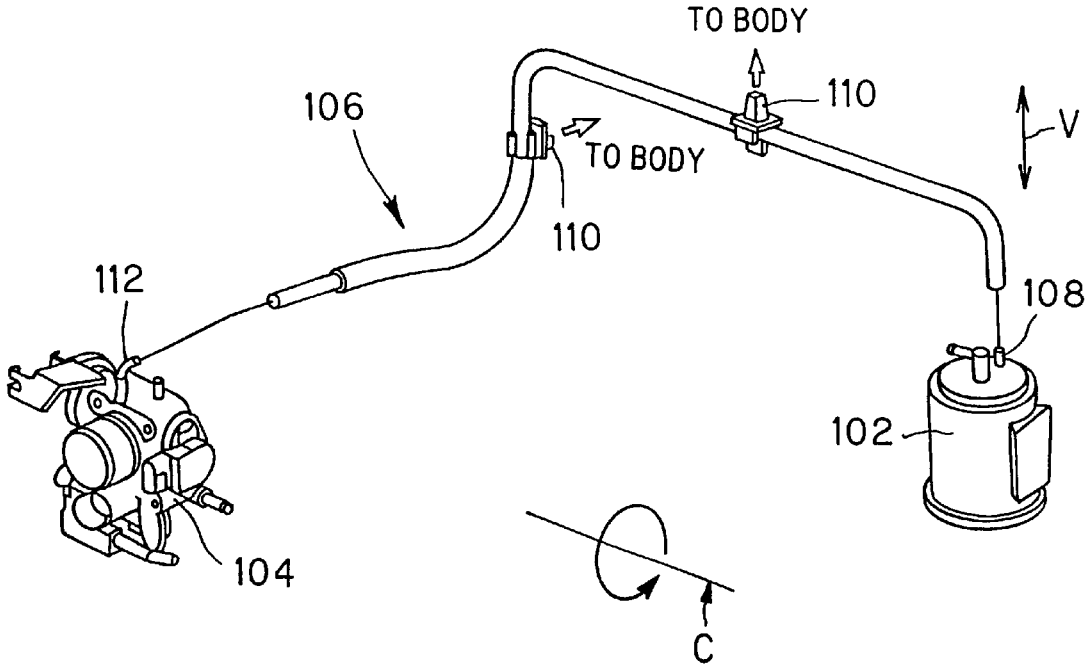
FIG. 10 (PRIOR ART)
FIG. 10 is a perspective view showing a known evaporated fuel piping construction.

FIG. 9 shows a fourth embodiment of the invention having the following features. That is, a purge pipe 72 is integrally and monolithically molded when the air cleaner casing 28 is molded. More specifically, the purge pipe 72 is extended along an inner surface of the air cleaner casing 28 and is integrally molded therewith.

With the arrangement of the fourth embodiment, it is possible to omit pipe holding portions for the air cleaner casing 28 for simplification of the arrangement, dispense with labor for assembly of the purge pipe 72 and reduce the pipe mounting procedure for simplification of the work and eliminate the danger of the purge pipe 72 falling off.

In addition, it is possible in the invention to apply the respective above-mentioned embodiments even in the case where the canister 42 is not placed in the engine room 8.

As apparent from the above description, according to the invention, a purge pipe member is composed of non-flexible pipe members fixed to engine accessories and flexible pipe members connected to the non-flexible pipe members such that the non-flexible pipe members, which constitute a part of the purge pipe member, are fixed to the engine accessory and the remaining part of the purge pipe member is constituted by the flexible pipe members, and so it is possible to shorten the piping path for improvement in invariability, ensure adequate clearances between the purge pipe member and other parts, and make the flexible pipe members of the purge pipe member small in sag.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. An evaporated fuel piping construction for a vehicular engine, comprising:

a purge pipe member provided between a canister and an intake system to conduct an evaporated fuel to the intake system from the canister, said purge pipe member comprising at least one non-flexible pipe member and at least one flexible pipe member connected to said at least one non-flexible pipe member; and an air cleaner including an air cleaner casing comprising a lower casing and an upper casing which are made from resin, wherein said at least one non-flexible pipe member is fixed to said lower casing of said air cleaner, wherein said purge pipe member is arranged in an axial direction of an engine crank shaft.

2. The evaporated fuel piping construction according to claim 1, wherein said at least one flexible pipe member is connected to a non-flexible purge side union of said canister held by the air cleaner mounted on a vehicle engine side.

3. The evaporated fuel piping construction according to claim 1, wherein said at least one non-flexible pipe member is mounted only on an outer surface of said lower casing.

4. The evaporated fuel piping construction according to claim 1, wherein said lower casing includes pipe mounting portions supporting said at least one non-flexible pipe member so that said upper casing of said air cleaner casing is removable to enable replacement of an air filter without adjustment of said pipe mounting portions.

5. The evaporated fuel piping construction according to claim 4, wherein said pipe mounting portions and said lower casing are monolithic.

6. The evaporated fuel piping construction according to claim 1, wherein said pipe mounting portions and said lower casing are monolithic.

7. An evaporative fuel piping arrangement for a vehicular engine, comprising:

a canister including a purge side union;

an intake system for receiving evaporated fuel from the canister;

a first flexible hose connected to said canister;

a second flexible hose connected to said intake system;

a single non-flexible purge pipe member connected at one end to said first flexible hose and at the other end to said second flexible hose, said purge pipe member provided between the canister and the intake system to conduct an evaporated fuel from the canister to the intake system; and an air cleaner including a lower casing and an upper casing made from resin, the lower casing including pipe mounting portions monolithic therewith at least at one exterior surface thereof, wherein said purge pipe member is fixedly secured to the pipe mounting portions of said lower casing and arranged in an axial direction of an engine crank shaft.

8. The evaporated fuel piping arrangement according to claim 7, wherein said air cleaner is mounted on a vehicle engine side that holds the canister and said purge pipe member is secured only to the pipe mounting portions at the exterior surface of the lower casing.

* * * * *